US007232276B2

(12) United States Patent
Oka et al.

(10) Patent No.: US 7,232,276 B2
(45) Date of Patent: Jun. 19, 2007

(54) ROAD REINFORCEMENT SHEET, STRUCTURE OF ASPHALT REINFORCED PAVEMENT AND METHOD FOR PAVING ROAD

(75) Inventors: Atsushi Oka, Yokohama (JP); Hiroaki Tomimoto, Yokohama (JP); Kazuaki Kouda, Yokohama (JP); Sachio Yokote, Tokyo (JP); Yoshiharu Miyasaka, Tokyo (JP); Yoshitaka Hoya, Takaishi (JP); Takashi Iiyama, Yokohama (JP)

(73) Assignee: Mitsui Chemicals, Inc., Tokyo (JP)

( * ) Notice: Subject to any disclaimer, the term of this patent is extended or adjusted under 35 U.S.C. 154(b) by 0 days.

(21) Appl. No.: 10/168,085

(22) PCT Filed: Dec. 18, 2000

(86) PCT No.: PCT/JP00/08950

§ 371 (c)(1),
(2), (4) Date: Jun. 17, 2002

(87) PCT Pub. No.: WO01/44579

PCT Pub. Date: Jun. 21, 2001

(65) Prior Publication Data

US 2003/0086762 A1 May 8, 2003

(30) Foreign Application Priority Data

Dec. 17, 1999 (JP) ..... 11-360046

(51) Int. Cl.
*E01C 3/06* (2006.01)

(52) U.S. Cl. ..... 404/31; 404/70

(58) Field of Classification Search ..... 404/17, 404/70, 71, 31

See application file for complete search history.

(56) References Cited

U.S. PATENT DOCUMENTS 3,732,791 A * 5/1973 Hohwiller et al. ..... 404/31
4,120,832 A * 10/1978 Ceintrey ..... 521/46.5
4,338,231 A * 7/1982 Marzocchi et al. ..... 523/214
4,453,360 A * 6/1984 Barenberg ..... 52/396.04
4,545,699 A * 10/1985 Uffner et al. ..... 404/31
4,699,542 A * 10/1987 Shoesmith ..... 404/70

(Continued)

FOREIGN PATENT DOCUMENTS

EP 0 318 707 * 6/1989

(Continued)

OTHER PUBLICATIONS

Manual for Asphalt Pavement, 1975 Fiscal Year Version, pp. 6-19, Japan Road Association.
Design of Pavement of Asphalt, pp. 88-101, Nichireki Kagaku Kogyo (1964).

*Primary Examiner*—Gary S. Hartmann
(74) *Attorney, Agent, or Firm*—Buchanan, Ingersoll & Rooney PC

(57) ABSTRACT

A paved road including a reinforcement sheet layer (1A) and a pavement layer (22), in which the reinforcement sheet layer (1A) includes an asphalt layer (2) laminated to at least one side of a reinforcement sheet (1) including a composite material that is impregnated with a thermoplastic resin to achieve a volume content of a continuous glass fiber, which is a reinforcement fiber, of not less than 30% and not moere than 85% is proved.

13 Claims, 8 Drawing Sheets

U.S. PATENT DOCUMENTS

| | | | | | |
|---|---|---|---|---|---|
| 4,957,390 | A | * | 9/1990 | Shoesmith | 404/70 |
| 5,246,306 | A | * | 9/1993 | Shoesmith et al. | 404/70 |
| 5,249,883 | A | * | 10/1993 | Watson et al. | 404/31 |
| 5,411,352 | A | * | 5/1995 | Eren | 404/31 |
| 5,476,340 | A | * | 12/1995 | Contrasto | 404/75 |
| 5,755,048 | A | * | 5/1998 | Lee | 37/403 |
| 5,836,715 | A | * | 11/1998 | Hendrix et al. | 404/134 |
| 5,941,656 | A | * | 8/1999 | Sugiyama et al. | 404/20 |
| 6,109,821 | A | * | 8/2000 | Montalbano et al. | 404/15 |
| 6,270,284 | B1 | * | 8/2001 | Sovik | 404/47 |

FOREIGN PATENT DOCUMENTS

| | | | | |
|---|---|---|---|---|
| EP | 0 957 203 | A1 | | 11/1999 |
| JP | 62-268413 | | | 11/1987 |
| JP | 64-014415 | | | 1/1989 |
| JP | 4-155052 | | * | 5/1992 |
| JP | 4-42168 | B2 | | 7/1992 |
| JP | 5-33522 | Y2 | | 8/1993 |
| JP | 7-083678 | A | | 3/1995 |
| JP | 08-281879 | | | 10/1996 |
| JP | 9-177014 | A | | 7/1997 |
| JP | 2893054 | B2 | | 3/1999 |
| JP | 11-323812 | A | | 11/1999 |

* cited by examiner

ROAD REINFORCEMENT SHEET, STRUCTURE OF ASPHALT REINFORCED PAVEMENT AND METHOD FOR PAVING ROAD

TECHNICAL FIELD

The present invention relates to a road reinforcement sheet in asphalt paved roads that can significantly improve durability to cracking and rutting due to traffic, and to an asphalt reinforced paved road using the road reinforcement sheet concerned, and especially to a road reinforcement sheet effective in reinforcing and making thinner asphalt paved road, and to an asphalt reinforced paved road. Furthermore, the present invention relates to a method for paving that enables thin layer pavement of a road, and to a method for repairing a paved road.

BACKGROUND OF THE INVENTION

In recent years, damages on road pavement occurs and safety and comfortableness of traveling are lowered due to the increased amount of road traffic and of large-sized car traffic. Especially in road pavement of heavy traffic route line, many damages as rutting by flowing of asphalt, cracking, etc. are observed. In order to secure traffic safety, remedial work is performed frequently and, as a result, social problem is being caused. Moreover, if cracking occurs on road pavement, rainwater will permeate therefrom and it will result in hurting subbase course further and promoting cracking. In bridge deck pavement, water that permeates into reinforced concrete floor slab from on bridge deck through asphalt pavement not only makes steel rod and steel materials inside the floor slab corroded, but especially promotes degradation of concrete, and of the floor slab concrete under conditions of repeated load applied, and then load-carrying capacity and durability are adversely affected.

Various methods are proposed in order to improve these rutting and crack of road pavement. As a general method, a cutting overlay method in which asphalt effective in rutting that has high anti-flowability and high abrasion resistance, and asphalt effective in crack prevention that has high crack-proof property are used for asphalt pavement as an asphalt mixture maybe mentioned. However, at present, these methods offer neither effective solution for suppressing both of rutting and crack of asphalt pavement face nor large life extension of the paved road.

Moreover, various methods and compositions that reinforce overlay of asphalt pavement are proposed. For example, as shown in Japanese Patent Laid-Open No. 62-268413 or Japanese Patent Laid-Open No. 64-14415, there is so-called geotextile method. In geotextile method, geotextiles are applied on subgrade, subsequently granular material, such as banking materials or gravel, are applied thereon, and pavement subbase course is formed to disperse and support load applied on the pavement. However, in this method of construction, most effects over damage on rutting, crack, etc. that take place on asphalt pavement surface are not demonstrated.

Moreover, a method is proposed in which a shearing force inside asphalt mixture in asphalt pavement is restrained to reinforce asphalt mixture using geotextile. As examples aiming at improvement in reinforcement performance of asphalt mixture, for example, an example in which a grid comprising uniaxially/biaxially drawn material of synthetic resin is used, and an example in which a grid comprising strands with glass fiber impregnated with resins is used may be mentioned.

However, a drawn portion of the grid of this synthetic resin has quite a low tensile strength of 0.4 GPa, and then in order to reinforce asphalt mixture, quite a big basis weight is needed. Moreover, also in a grid using glass fiber, a defect is observed in which tensile strength falls by cutting of fiber by being worn and hooked at the time of paving asphalt.

Moreover, in these grids of glass fiber, or synthetic resin grid having high rigidity, in order to obtain high material strength, rigidity as a geotextile is set high. These geotextiles cannot be continuously rolled out at the time of application, and for this reason, difficulty in handling when applied is observed.

Besides, since this geotextile is used being inserted between lower layer and upper layer of asphalt, slide prevention and bonding strength between the upper layer and the lower layer need to be strengthened. Therefore, this geotextile has a form of grid. Consequently, it has a defect that decay of subbase course and subgrade by rainwater coming in via cracks that take place on asphalt pavement surface or damage portion cannot be prevented.

As a result of wholehearted research by the present inventors in order to solve the above described problem, it turned out that asphalt pavement is strengthened and permeation of rainwater etc. is effectively prevented by using a sheet for road reinforcement given in Japanese Patent Laid-Open No. 09-177014, and a big effect is demonstrated thereby to reflection crack and crack of asphalt surface course.

In the above described Japanese Patent, a sheet for road reinforcement has compatibility with asphalt pavement, at a temperature of asphalt mixture at the time of application (usually not less than 110° C.), asphalt of the sheet for road reinforcement melts, and forms a good plane for joint between asphalt pavement and the sheet, and unites with it. By this adhesive effect demonstrated, the sheet for road reinforcement can suppress a flow of asphalt pavement, and also can decrease a deflection of pavement material, resulting in suppression of phenomenon of rutting or crack. Consequently, it is indicated that the durability of not less than double is demonstrated compared with usual paved roads to phenomenon of crack or rutting observed on a road surface.

Besides, as shown in Japanese Patent Application No. 07-083678, a sheet for road reinforcement of this Japanese Patent Laid-open No. 09-177014 also has waterproofing function as a compound waterproofing sheet, and has reflection crack preventive ability, and also has waterproof ability for bridge deck pavement.

However, damage of asphalt pavement has become markedly increased due to increase in automobile traffic and enlargement of truck in recent years. Moreover, since requests to paved road from user of road or residents along the route is diversified, a pavement with special function in which outstanding durability, safety of traffic, environment, and cost reduction and long life are taken into consideration is desired, and therefore various multifunctional pavements are developed. As examples, drainage pavement with drainage function and noise reduction function, thin layer asphalt pavement, recycled improved asphalt mixture using recycled aggregates, and heated asphalt mixture in which slag of molten and cooled incinerated ashes of domestic wastes, crushed waste glass, waste plastic, piece of cutting of waste PET bottle, etc. are mixed as aggregate attract attention recently.

For example, a drainage pavement technical guiding principle (proposal) about drainage pavement is published, and in it asphalt with high viscosity is usually used as a binder of asphalt mixture used for a drainage pavement, and emulsified rubberized asphalt as tack coat.

Even if a sheet for road reinforcement given in Japanese Patent Laid-Open No. 09-177014 is used to an asphalt pavement using these asphalt mixtures, sufficient effect may not be demonstrated to crack and rutting that are formed in an asphalt pavement face.

The present inventors proceeded further a research about materials and methods for manufacturing, etc. that also support such various multifunctional pavements and that can also solve these problems.

The present invention is to offer a paved road that may cancel the above described defects.

One of the further large subjects of the present invention is decreasing an amount of asphalt used for pavement, i.e., enabling thin surfacing (thin layer pavement) with thickness of asphalt made thinner.

Thickness of asphalt used for pavement of road is indicated by various outlines and references. For example, according to MANUAL FOR ASPHALT PAVEMENT (1975 fiscal year version, 6–19 pages: Japan Road Association), thickness of surface asphalt is designed based on traffic of car;

A-case (less than 250 cars/day): Surface course asphalt 5 cm,

B-case (ibid. 250–1000 cars/day): Surface course asphalt 5 cm,

C-case (ibid. 1000–3000 cars/day): Surface course asphalt 10 cm,

D-case (not less than 3000 cars/day): Surface course asphalt 15 cm*.

* Included binder course

Besides, according to asphalt pavement basic lecture; design of pavement of asphalt (Nichireki Kagaku Kogyo), it indicates that "generally, asphalt mixture is finished one layer up to 6 cm of thickness, and beyond it, finished in multilayered on the basis of 5 cm in thickness", and also that "(as thickness of asphalt) surface course with a thickness of 5 cm on an upper subbage course may be made - - - omitting binder course, on the basis of 10 cm of standard for sum total of surface course and binder course, in the case where unit section automobile traffic is less than 2000 sets/day."

Besides, although Japanese Patent Laid-Open No. 9-177014 is a patent using a reinforcement sheet and there is indicated that a strength of a road improves by use of a reinforcement sheet, but only an examination result of a road with a thickness of 5 cm is indicated in Example.

It was considered that it was very difficult to make a thickness of a surface course asphalt thinner than 5 cm from the above described design value etc. As described above, in road pavement, actual situation was that a subject was not taken into consideration in which a thickness is to be made thinner, based on old customs or regulations of construction outline etc. that surface course asphalt is to be not less than 5 cm.

It requires time of construction that thick asphalt is used, and huge quantity of asphalt is used for it.

Furthermore, in repair of a road, or reconstruction of asphalt, cutting of the asphalt is needed, and cutting generates noise and dust, therefore a great trouble is made to residents along the route, and legal restrictions are also applied about noise.

If asphalt used is thick, a long construction period will be required, and increase in an amount of cutting asphalt abandonment and construction period over a long period of time lead to problems in which influences on financial or environmental problems, such as traffic interception over a long period of time, bad environment for residents along the route, and high road repairing expense etc. become larger. It is very serious subject to mitigate these problems.

DISCLOSURE OF THE INVENTION

The present invention solves the above described problems and aims at providing a road reinforcement sheet that may markedly decrease damages of rutting and crack, etc. generated on asphalt pavement surface, and an asphalt reinforced paved road using the road reinforcement sheet concerned, and especially at providing a road reinforcement sheet effective in reinforcing and thin-layering of asphalt paved road, and the asphalt reinforced paved road.

The present inventors have come to complete the present invention, as a result of repeated and wholehearted examination in order to attain the above described purpose. That is, the present invention includes the following invention.

(A) A paved road including reinforcement sheet layer (1A) and pavement layer (22), in which said reinforcement sheet layer (1A) includes an asphalt layer (2) laminated to at least one side of a reinforcement sheet (1) including composite material that is impregnated with thermoplastic resin so that a volume content of a continuous glass fiber is not less than 30% and not more than 85% using the continuous glass fiber as reinforcement fiber.

(B) The paved road according to (A) in which the reinforcement sheet layer (1A) is further a reinforcement sheet layer (1B) having a woven fabric layer or a nonwoven fabric layer (3) containing natural fiber or synthetic fiber on at least a part of face between the reinforcement sheet (1) and the asphalt layer (2).

(C) The paved road according to (A) including reinforcement sheet layer (1A) and pavement layer (22) in which said reinforcement sheet layer (1A) includes an asphalt layer (2) laminated to both sides of a reinforcement sheet (1) including a composite material that is impregnated with a thermoplastic resin so that a volume content of a continuous glass fiber is not less than 30% and not more than 85% using the continuous glass fiber as reinforcement fiber.

(D) The paved road according to any of (A) to (C), in which the reinforcement sheet (1) has a tensile strength of not less than 290 MPas, a tensile elongation of not more than 10%, a coefficient of thermal expansion of $2\times10^{-6}$ to $8\times10^{-6}$/°C., and a thickness of 100 micrometers to 600 micrometers.

(E) The paved road according to any of (A) to (D), in which the asphalt layer (2) has a thickness of not less than 400 micrometers and not more than 2000 micrometers.

(F) The paved road according to any of (A) to (E), in which when shearing peel strength being performed for the reinforcement sheet (1) and the asphalt layer (2), the layers are bonded mutually by strength of not less than force of coagulation of asphalt layer (2).

(G) The paved road according to any of (A) to (F) comprising a notably thin pavement layer having a pavement layer (22) with a thickness of less than 50 mm whose fracture energy by bending test is not less than 4 [kN-mm], and a function notably excellent in crack-proof performance.

(H) The paved road according to any of (A) to (G) comprising a notably thin pavement layer having a pavement layer (22) with a thickness of less than 50 mm whose dynamic stability by wheel tracking test is not less than 600 [turn/mm], and a function notably excellent in rutting-proof property.

(I) The paved road according to any of (A) to (H) in which the pavement layer (22) has drainage property, and the reinforcement sheet layer (1A or 1B) has seepage control property, comprising a function of draining rainwater in a direction of road shoulder along upper surface of the reinforcement sheet layer (1A or 1B) without permeating rainwater penetrated via the pavement layer (22) into subbase course.

(J) The paved road according to any of (A) to (I) in which thickness of the pavement layer (22) is not more than 4.5 cm.

(K) The paved road according to (J) in which thickness of the pavement layer (22) is 4 to 1.5 cm.

(L) A structure of a road in which the reinforcement sheet layer (1A or 1B) according to any of (A) to (C) is applied and the road reinforcement sheet makes a surface course without asphalt applied thereon.

(M) A structure of temporary road used during road repairing in which the reinforcement sheet layer (1A or 1B) according to any of (A) to (C) is applied and the road reinforcement sheet makes a surface course without asphalt applied thereon.

(N) A repairing method of a paved road in which in case of formation of crack, rut, or loss portion on a pavement surface on the paved road with asphalt or concrete, the structure of the paved road according to any of (A) to (K) is prepared after at least a part of a surface of the paved road is cut, and after the crack or the loss portion is partially repaired if needed.

(O) A repairing method of a paved road in which the structure of the paved road having a function of draining rainwater in a direction of road shoulder according to (I) is prepared after a surface is cut and a crack or loss portion is partially repaired on the paved road with asphalt or concrete.

EXPLANATION OF LETTERS OR NUMERALS

Figure 1:
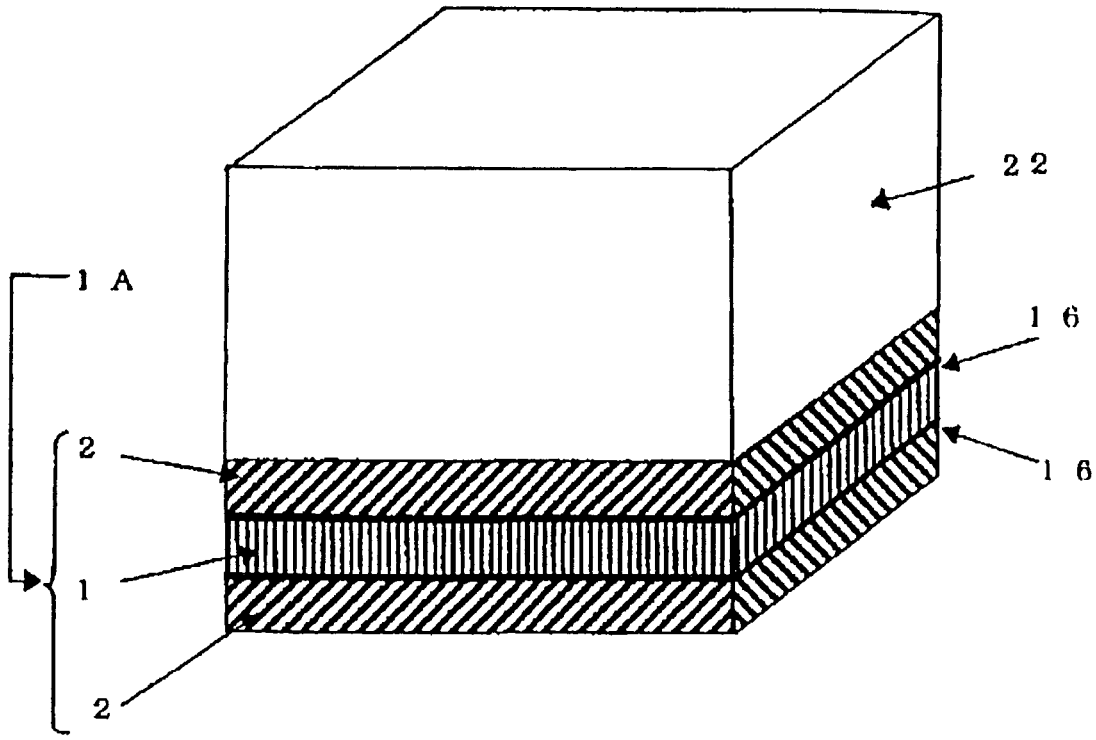
FIG. 1 is a perspective view showing one embodiment of a paved road according to the present invention.
Figure 2:
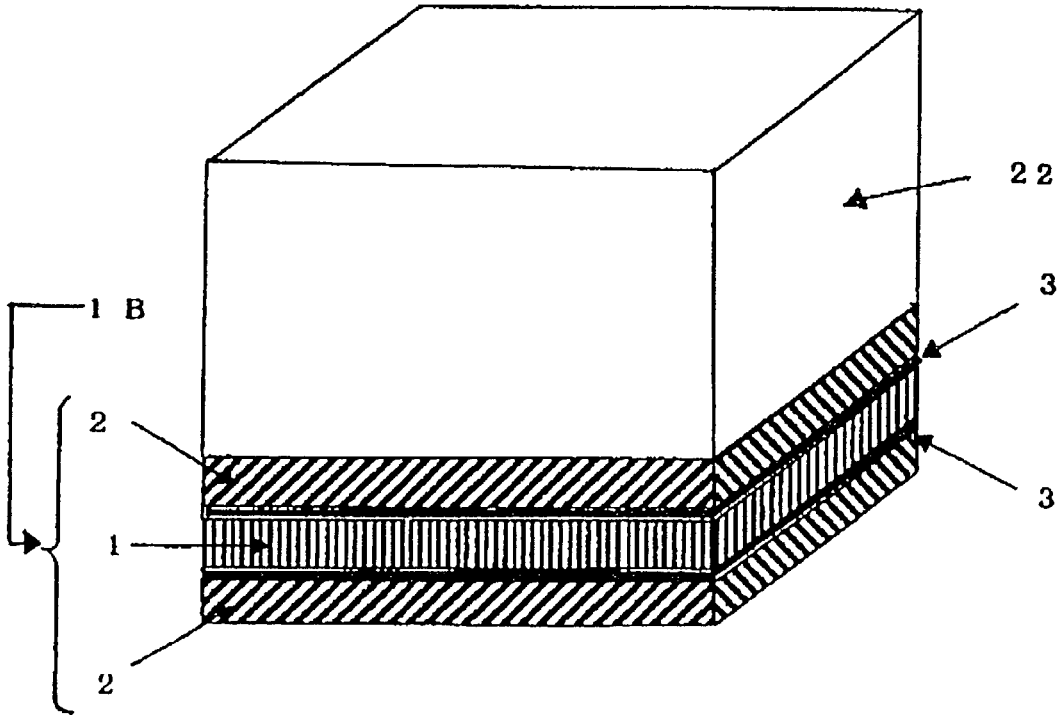
FIG. 2 is a perspective view showing another embodiment of a paved road according to the present invention.
Figure 3:
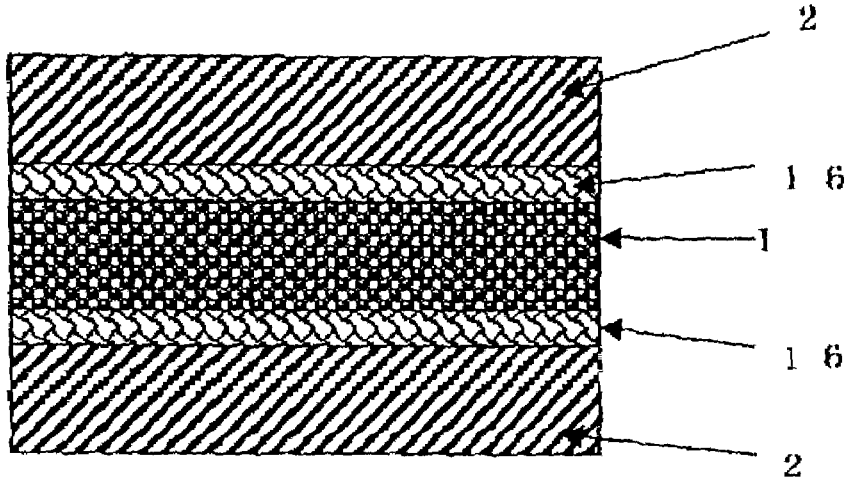
FIG. 3 is a figure showing a cross section of a road reinforcement sheet layer used in FIG. 1.
Figure 4:
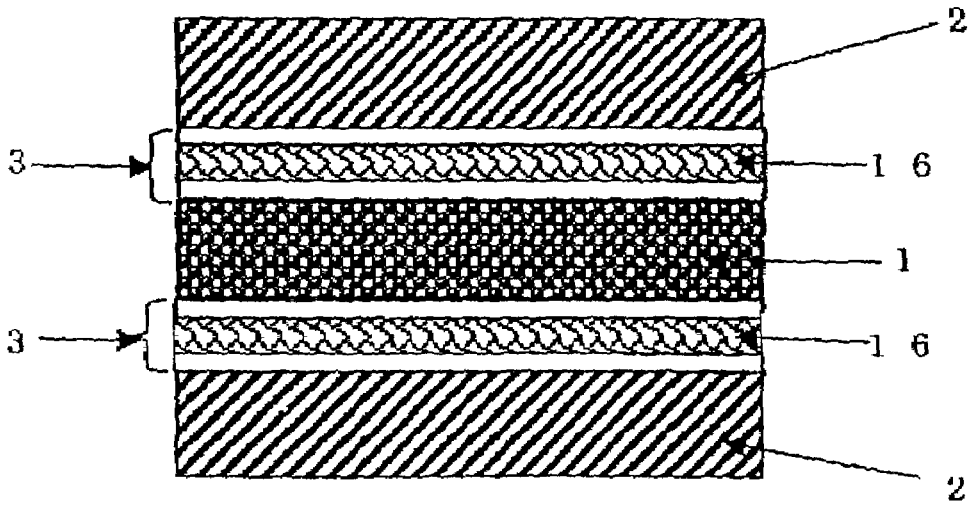
FIG. 4 is a figure showing a cross section of a road reinforcement sheet layer used in FIG. 2.

1A: Road reinforcement sheet, 1B: Road reinforcement sheet, 1: Reinforcement sheet, 2: Asphalt layer, 3: Woven fabric or nonwoven fabric comprising fibers, 4: Surface course (asphalt mixture), 5: Binder course (asphalt mixture), 6: Subbase course, 7: Lower layer subbase course (crusher-run), 8: Upper subbase course (mechanically stabilized crushed stone), 9: Styrene foam board, 10: Layer of asphalt stabilization, 11: RC floor slab, 12: Mastic asphalt layer, 13: Cutting road surface, 14: Jet cement, 15: Drainage pavement, 16: Molten adhered layer, 17: Heater, 18: Heating roll, 19: Cooling roll, 20: Vat, 21: Roll for application, 22: Solid tire, 23: Load, 24: Imitation subbase course

PREFERRED EMBODIMENTS OF THE INVENTION

The present invention relates to a road reinforcement sheet in which on both sides of a reinforcement sheet (1) having a tensile strength of not less than 290 MPas, a tensile elongation of not more than 10%, a coefficient of thermal expansion of $2\times10^{-6}$ to $8\times10^{-6}$/°C., and a thickness of 100 micrometers to 600 micrometers an asphalt layer (2) having a thickness of not less than 400 micrometers and not more than 2000 micrometers is bonded to the reinforcement sheet (1) with not less than a force of coagulation of the asphalt layer (2) in shearing peel strength, and to a structure of an asphalt reinforced paved road in which crack performance and rutting-proof performance are markedly improved in which the road reinforcement sheet concerned is paved at a depth of less than 5 cm from an asphalt surface side of an asphalt pavement to be reinforced.

A paved road of the present invention is notably excellent in crack-proof property, and has fracture energy by bending test of not less than 4 [kN-mm], and in general 4 to 40 [kN-mm]. Moreover, it is excellent also in wheel tracking property, and has a dynamic stability of not less than 600 turn/mm, and in general about 600 to 15000 turns.

The present invention provides a structure of an asphalt reinforced paved road with markedly improved crack performance and rutting-proof performance in which a road reinforcement sheet is paved at a depth of less than 5 cm, preferably less than 4.5 cm, and more preferably 4 to 1.5 cm from an asphalt surface side of the asphalt pavement to be reinforced. Moreover, the present invention also includes a temporary construction road used during road repairing in which a road reinforcement sheet is paved, and the road reinforcement sheet makes a surface course without paving asphalt thereon.

A road reinforcement sheet of the present invention and a structure of an asphalt reinforced paved road using the road reinforcement sheet concerned will be hereinafter described in detail using drawings.

A reinforcement sheet (1) of the present invention is a sheet-like substance that has a tensile strength of not less than 290 MPas, a tensile elongation of not more than 10%, a coefficient of thermal expansion of $2\times10^{-6}$ to $8\times10^{-6}$/°C., and a thickness of 100 micrometer to 600 micrometers, and is not especially limited as long as it has the above described performances. For example, although metal foil and composite material etc. may be mentioned, it is preferable to choose a reinforcement sheet (1) that may bond so that a shearing peel strength between the reinforcement sheet (1) and an asphalt layer (2) of the present invention may be more than a force of coagulation of the asphalt layer (2). In the light of such viewpoints, it is preferable to use composite materials comprising reinforcement fibers and polymer resins as reinforcement sheets (1).

Although the kind of fiber is not especially limited when using composite materials as a reinforcement sheet (1) of the present invention, for example, glass fibers, carbon fibers, aramid fibers, silicon carbide fibers, etc. are typical examples. As especially preferable fiber, glass fibers may be mentioned, and more preferably continuous glass fibers.

Moreover, as thermoplastic resins used for reinforcement sheet (1) of the present invention, although they are not especially limited, for example, polypropylenes; polyethylenes; ethylene propylene copolymers; polyolefins based resins, such as homopolymers and copolymer of α-olefins; homopolymers, such as styrene and methyl styrene; polystyrene based resins, such as copolymers of these monomers and α-olefins; homopolymers of vinyl chloride; polyvinyl chloride based resins, such as copolymers of the monomer and α-olefins may be used. In addition, various kinds of resins, such as AS resins, ABS resins, ASA resins (polyacrylonitrile-polystyrene-polyacrylate), polymethylmethacrylates, nylons, polyacetals, polycarbonates, polyethylene terephthalates, polyphenylene oxides, fluororesins, polyphenylene sulfides, polysulfones, polyether sulfones, polyether ketones, polyether ether ketones, polyimides, and polyarylates, may also be used, and in the light of strength, abrasion resistance, price, and reproductive easiness as waste, as most desirable resins, general-purpose polyolefin based resins, such as polyethylenes and polypropylenes, and polystyrene based resins, polyvinyl chloride based resins, and nylons are recommended.

When composite materials are used as reinforcement sheets (1) of the present invention, it is preferable to make thermoplastic resins impregnated so that a volume content of the reinforcement fiber may be in a range of not less than 30% and not more than 85%, and more preferably of not less than 30% and not more than 80%.

When a strength of the sheet and flexibility are taken into consideration, a thickness of the reinforcement sheet (1) of the present invention is preferably 100 micrometers to 600 micrometers, and more preferably 150 micrometers to 550 micrometers. A sufficient strength may be obtained with thickness of reinforcement sheet (1) of not less than 100 micrometers, flexibility of the sheet is suitable with thickness of less than 600 micron, and good application property as a road reinforcement sheet may be demonstrated.

Various methods may be mentioned in order that a reinforcement sheet (1) of the present invention may attain both performances of not less than 10% of degree of tensile elongation, and $2\times10^{-6}$ to $8\times10^{-6}$/°C. of coefficient of thermal expansion, and in the case where a composite material is used as a reinforcement sheet (1), it is preferable to use a reinforcement sheet (1) in which a plurality of sheets wherein continuous reinforcement fibers are arranged in one direction and impregnated in a thermoplastic resin are orthogonally laminated.

As long as a method for manufacturing a sheet impregnated in thermoplastic resin used in a method of the present invention demonstrates the above described physical properties, it will not be especially limited, and for example, the sheet may be manufactured by a method given in Claims and Examples of Japanese Patent Publication No. 4-42168.

In claim 1 of the Publication, a method is disclosed in which while a thermoplastic resin is applied to at least one belt of a pair of belts heated not less than softening point of the thermoplastic resin the applied film is introduced between a pair of belts that face each other, and the thermoplastic resin is impregnated into fibers by passing a fiber sheet between the one pair of belts to manufacture a fiber reinforcement sheet-like prepreg, and methods being dependent to the method in detail are indicated. More specifically, it is constituted by fiber delivery section, feeding section, resin impregnating section, and taking up section as shown in this Publication FIG. 1, and details of FIG. 1 are indicated in detailed description.

A prepreg used in the present invention is indicated in Japanese Patent Laid-Open No. 9-177014.

In a prepreg of the present invention, reinforcement fiber has a constitution in which continuous filaments are aligned almost uniformly in one direction. As fibers used for a prepreg, although, for example glass fibers, carbon fibers, aramid fibers, silicon carbide fibers, etc. are typical examples, they are not limited to them. As especially preferable fibers, glass fiber may be mentioned.

As the fibers, fibers are usually used in which predetermined number of yarns or rovings that have 200 to 12000 monofilaments with thickness of 3 to 25 micrometers in strand are arranged in one direction. When glass fiber is used as the fiber, various kinds of surface treatments are usually applied to increase adhesion with resins. Surface treatment is applied combining binders and coupling agents.

As a specific example of manufacturing method of a prepreg, a method currently indicated by Japanese Patent Publication No. 04-042168, for example, may be mentioned. In the case of glass fiber, by this method, for example, surface of a monofilament with a thickness of 13 micron is treated with γ-methacryloxy-propyl trimethoxy silane, and 1800 of them are bundled to obtain a yarn without twist. While aligned in one direction 80 yarns are pulled by uniform tension, resin is applied to the yarns, subsequently pressed by heating roll, and made to impregnate into the yarns to manufacture the prepreg.

Further, more specifically, a method for manufacturing a prepreg is indicated in paragraph (0032) of Japanese Patent Laid-Open No. 9-177014, and a method for manufacturing a reinforcement sheet is indicated in paragraph (0034), and what are manufactured by this method may be used. Preferably, a reinforcement fiber is glass fiber and a resin is polypropylene. For example, "Preglon" (Trade name: manufactured by Mitsui Chemicals, Inc.) may be used.

Moreover, in a reinforcement sheet (1) of the present invention, woven fabric layer or nonwoven fabric layer (3) comprising fiber materials may be configured on whole surface or a part of one side or both sides. In this case, as woven fabric or nonwoven fabric used for reinforcement sheet (1), a cloth generally comprising fibers, such as natural fibers, for example, hemp and cotton as vegetable fibers; silk and wool as animal fibers; asbestos as mineral fiber; and a cloth made from polymer fibers and polymer filaments; for example, high molecular weight high density polyethylenes, polypropylenes, polyvinyl chlorides, polyvinylidence chlorides, polystyrenes, polyvinyl alcohols, polyesters, and nylons; and various copolymers of them may be used. Although woven fabric or nonwoven fabric comprising polyesters and various copolymers of them, etc. are preferable when processing temperature in producing reinforcement sheet (1) and processing temperature at time of subsequent preparing asphalt layer (2), etc. are taken into consideration, there is not especially any limitation.

An amount of basis weight per unit area of a woven fabric or nonwoven fabric comprising fiber materials used in the present invention is 10 g/m$^2$ to 500 g/m$^2$, and preferably is 15 g/m$^2$ to 60 g/m$^2$. Using woven fabric or nonwoven fabric comprising such fiber materials, asphalt is impregnated into fiber material portion to increase adhesive strength and also durability of a road reinforcement sheet itself.

A road reinforcement sheet of the present invention may be obtained by carrying out heat welding of an asphalt layer (2) at both sides of the above described reinforcement sheet (1).

As materials that constitute asphalt layer (2) used in the present invention, straight asphalt, blown asphalt, improved asphalt, etc. may be mainly mentioned, and more preferably improved asphalt may be mentioned. As long as asphalt layer (2) used for the present invention satisfies this condition, there is not any other limitation.

There may be obtained improved asphalt with modifiers, such as rubbers and thermoplastic elastomers, added thereto raise 60° C. viscosity, besides semi-blown asphalt with raised viscosity that is obtained by oxidation polymerization caused by air blown into a straight asphalt at high temperature, as this improved asphalt, and all of these improved asphalts may be used for the present invention. Rubbers, resins, etc. are used as modifiers for improved asphalt. Rubbers used as additives are usually synthetic rubbers, and styrene butadiene rubbers, styrene-butadiene block copolymers, styrene butadiene copolymers, chloroprene butadiene nitrile copolymers, isobutylene isoprene copolymers, etc. may be mentioned. Generally the amount of addition of the rubbers is 2 to 5 weight %. Moreover, in addition, styrene-isoprene block polymers and ethylene-vinylacetate copolmers (EVA), ehtylene-ethylacrylate copolymer (EEA) etc. may be mentioned.

In a road reinforcement sheet of the present invention, 60° C. viscosity of an asphalt layer (2) of the road reinforcement sheet of the present invention is raised, and anti flowability, adhesive property with adherend, and toughness are improved using improved asphalt as the asphalt layer (2). Consequently, the adhesive property between the reinforcement sheet (1) and the asphalt layer (2) will improve further. Moreover, as mentioned above, performance of the asphalt layer (2) is improved and, as a result, the road reinforcement sheet concerned firmly adheres to asphalt pavement and substrate adherend, etc., mechanical performance of the reinforcement sheet (1) maybe given to asphalt structure, and thereby rutting and crack generated in asphalt paved roads may be efficiently suppressed.

Thickness of an asphalt layer (2) of the present invention is usually 300 micrometers to 4000 micrometers, and preferably 400 micrometers to 2000 micrometers. An amount of asphalt of an asphalt layer (2) is suitable in thickness of the asphalt layer (2) being not less than 300 micrometers, and while formation of a layer is possible, adhesion with substrate layer at the time of application is excellent. Moreover, when a thickness of an asphalt layer (2) is not more than 4000 micrometers, there are no problems at time of manufacturing a road reinforcement sheet such as degassing, thickness irregularity, and surface property, and the road reinforcement sheet is flexible, weight is suitable and application property at the time of application is well demonstrated while layer formation of the asphalt layer (2) is attained.

As a method for manufacturing a road reinforcement sheet of the present invention, a method is adopted in which a reinforcement sheet (1) is heated at more than melting temperature of a thermoplastic resin used for the reinforcement sheet (1), then the reinforcement sheet (1) and an asphalt layer (2) concerned are melted or admixed, and subsequently solidified and uniformly laminated.

Also in the case where a woven fabric or nonwoven fabric (3) comprising fiber materials is configured on whole surface or a part of one side or both sides as a reinforcement sheet (1) a thermoplastic resin and asphalt are melted or admixed mutually, and subsequently solidified and uniformly laminated in a portion of fiber materials. In this case, in an interface of the thermoplastic resin and the asphalt, a state is formed in which the thermoplastic resin and asphalt are melted or admixed mutually to fiber materials and solidified, and a constitution of a kind of composite material is formed. Consequently, adhesive strength between the reinforcement sheet (1) and the asphalt layer (2) improves, and the durability of the road reinforcement sheet itself also further improves.

Generally as a method for manufacturing a road reinforcement sheet, although there are a method in which the reinforcement sheet (1) is dipped into molten asphalt in the state where it is heated or not heated at not less than the melting temperature of a thermoplastic resin used for the reinforcement sheet (1) concerned, and a method of roll coating may be mentioned, there is no limitation for the method for manufacturing as long as a sheet is obtained in which asphalt layer (2) is melted or admixed mutually to both sides of the target reinforcement sheet (1) to form a solidified state.

A road reinforcement sheet of the present invention has a reinforcement sheet (1) having a tensile strength of not less than 290 MPas, a tensile elongation of not more than 10%, a coefficient of thermal expansion of $2\times10^{-6}$ to $8\times10^{-6}$/° C., and a thickness of 100 micrometer to 600 micrometers, as component. As an example, when a reinforcement sheet (1) in which a plurality of sheets wherein continuous reinforcement fibers are arranged in one direction and impregnated in a thermoplastic resin are orthogonally laminated is used, a tensile strength of the road reinforcement sheet concerned shows a strength of not less than 49 kNs per meter, and a tensile elongation shows not more than 10%.

Moreover, since the road reinforcement sheet concerned has the asphalt layer (2) with thickness of 400 micrometers to 2000 micrometers as the uppermost surface course, adhesive property with adherend as component of pavement, such as asphalt paving mixture and concrete floor slab, is very highly demonstrated. Moreover, since asphalt layer (2) is bonded with not less than cohesion of asphalt layer (2) in shearing peel strength with reinforcement sheet (1) in a road reinforcement sheet of the present invention, it becomes possible that a state maybe formed where asphalt paving mixture and concrete floor slab, etc. as adherend and the reinforcement sheet (1) concerned are firmly bonded by combining with asphalt paving mixture used for asphalt paving. Therefore, it becomes possible to give mechanical performance of the reinforcement sheet (1) to asphalt structure to improve strength of the asphalt paving, and while crack formed on the asphalt paving is reduced, rutting by flow of asphalt paving mixture is inhibited.

Moreover, since asphalt layer (2) is bonded with not less than cohesion of asphalt layer (2) in shearing peel strength with reinforcement sheet (1) in a road reinforcement sheet of the present invention, it is firmly bonded with asphalt paving mixture, concrete floor slab, etc. as adherend. Thereby, since mechanical performance of the reinforcement sheet (1) may be efficiently demonstrated, traffic is possible especially as a temporary road, without carrying out paving of an asphalt mixture on the road reinforcement sheet concerned after paving of the road reinforcement sheet concerned.

In the present invention, when a reinforcement sheet in which a plurality of sheets wherein continuous reinforcement fibers are arranged in one direction and impregnated in a thermoplastic resin are orthogonally laminated is used as a reinforcement sheet (1), this effect may be still highly demonstrated.

Next, a structure of an asphalt reinforced paved road using a road reinforcement sheet of the present invention will be described. Although a structure of usual asphalt paving is constituted on a subgrade in sequence of a subbase course, a binder course (5), and a surface course (4), in some case a surface course (4) may be paved directly on a subbase course (6) without a binder course (5). Moreover, when foundation is a soft ground, sometimes asphalt stabilization method in which asphalt (straight asphalt, emulsified asphalt, cutback asphalt, etc.) is added into local material or materials with supplementary material added thereto on a subgrade and is processed may be performed. A subgrade represents a portion with a thickness of 1 m under pavement, and is a portion 1 m under from a face of finished banking in banking, and a portion 1 m under from a face in excavated face in cut portion. A subgrade serves as foundation that determines a thickness of the pavement.

A subbase course is a layer made to disperse traffic load and safely transmit to a subgrade. Therefore, it must be a layer in which materials having sufficient bearing capacity and is moreover rich in durability fastened and hardened enough with required thickness. In order to obtain an economically and dynamically balanced configuration, a subbase course is usually paved being divided into a lower layer subbase course (7) with cheaper materials having comparatively small bearing capacity therein, and an upper subbase course (8) with better-quality materials having bigger bearing capacity. Materials used for the lower layer subbase course (7) and the upper subbase course (8) are local materials, mechanically stabilized crushed stone, crusher-run slag, pit gravel, pit run gravel, or sand.

A surface course (4) and a binder course (5) are portions most influenced by traffic load or atmospheric phenomena action, and hot asphalt mixture is used here. As kind of hot asphalt mixture, a coarse grade asphalt concrete in binder course (5), a dense grade asphalt concrete, a fine grade asphalt concrete, and dense grade gap asphalt concrete in surface course (4) are used as a standard. In recent years, asphalt mixture for drainage pavement may be used sometimes for reduction of noise, and rainwater elimination on road surface. In selection of asphalt paving mixture used for a surface course (4) and a binder course (5) of the present invention, selection is done in consideration of atmospheric phenomena conditions, traffic conditions, application conditions, etc., and there is not especially limitation.

As a structure of an asphalt reinforced paved road of the present invention, a structure in which a road reinforcement sheet is paved on a cutting road surface (13) or a subbase course (6), and a binder course (5) and a surface course (4) are paved in sequence, or only a surface course (4) is paved, and a structure in which a road reinforcement sheet is paved on a binder course (5) and a surface course (4) is then paved may be mentioned. Such structures are selected based on constitutions of a road, application of a road reinforcement sheet (for example, in order to suppress crack of asphalt paving face, to suppress rutting by flow of asphalt, to reinforce asphalt mixture for drainage pavement, to reinforce thin surfacing, to pave water resistant layer under asphalt paving etc.) and application conditions.

As a method of forming a structure of an asphalt reinforced paved road of the present invention, a method in which attaching is carried out on an adherend to which the road reinforcement sheet is paved while pouring heated and molten asphalt, a method in which attaching is carried out on an adherend by melting asphalt on front face of road reinforcement sheet with torch burner, and a method in which attaching is carried out on an adherend with heat of asphalt mixture used for asphalt paving may be mentioned, and the method is not especially limited as long as adhesion is carried out to the adherend with enough strength.

Although examples will be shown below as methods for forming a structure of an asphalt reinforced paved road of the present invention, the present invention is not limited with following examples.

When a crack of an asphalt paving face is suppressed using a road reinforcement sheet, heated and molten asphalt is poured on cutting road surface (13) to cover the crack of the road surface, and the road reinforcement sheet concerned is applied, while leveling concavo-convex of the road surface.

After the completion of paving of a road reinforcement sheet, in the case where a surface course (4) is laid and spread, a temperature of an asphalt paving mixture needs to be surely not less than 110° C. In the case of not more than 110° C., application must not be carried out. After surface course (4) is laid and spread, iron ring roller and pneumatic tire roller are used for compaction, and thereby heat is conducted to a binder course (5) to melt the asphalt, and as a result the binder course (5), the road reinforcement sheet, and the surface course (4) are unified further firmly.

When carrying out a pavement with remarkably excellent rutting performance using a road reinforcement sheet, the road reinforcement sheet concerned is applied on binder course (5). In this case, as a binder course (5), for example, a coarse grade asphalt blend is laid and spread by an asphalt finisher etc. on a subbase course (6), pressed and compacted using iron ring roller and pneumatic tire roller for compaction, and subsequently road reinforcement sheet is paved. As a method of paving the road reinforcement sheet concerned and of adhering to adherend, a method in which the road reinforcement sheet concerned is paved while heated and molten asphalt is poured on a road surface, or a method in which the road reinforcement sheet is directly paved, and the sheet is melted with heat of the binder course (5) to be adhered to the binder course (5) if a temperature of the binder course (5) after pressed and compacted is not less than 110° C. may be mentioned. However, when a temperature of the binder course (5) after pressed and compacted is not more than 110° C., the road reinforcement sheet is directly heated with a direct fire of torch burners etc. to melt the sheet, and the road reinforcement sheet is paved while being adhered with the binder course (5). After completion of paving of the road reinforcement sheet, in the case where a surface course (4) is laid and spread, a temperature of an asphalt paving mixture needs to be surely not less than 110° C. In the case of not more than 110° C. application must not carried out. After surface course (4) is laid and spread, iron ring roller and pneumatic tire roller are used for compaction, and thereby heat is conducted to a binder course (5) to melt the asphalt, and as a result the binder course (5), the road reinforcement sheet, and the surface course (4) are further firmly unified.

In order to greatly raise performance to suppress crack formed on a surface of a paved road and rutting by flow of asphalt that are primary objects of the present invention it is necessary that location may be adjusted where road reinforcement sheet is paved, and thickness of asphalt mixture layer on the road reinforcement sheet concerned may be adjusted. That is, in order to raise greatly crack suppression performance formed on the surface of paved road, it is preferable to pave the road reinforcement sheet in a portion near forming source of the crack. Moreover, in order to greatly raise suppression performance of rutting by flow of asphalt, it is preferable to pave the road reinforcement sheet concerned in a portion near asphalt front face of the surface course (4), and it is still more preferable to pave the road reinforcement sheet concerned in a portion of asphalt front face in less than 4 cm from the surface course (4).

Generally in maintenance and repairing of asphalt paved road of these days, a method is adopted in which asphalt mixture is poured into damaged part as a temporary measure for repairing rutting and crack formed on asphalt paving front face. However, this repairing method is not an essential repair but a temporary solution method, and damages maybe formed in the asphalt paving face again by passage of time. Therefore, in general, evaluation is to be carried out to these asphalt paved roads, and construction using replacing method and cutting overlay method, etc. are adopted.

However, when a replacing construction method is carried out, there occur problems such as, long construction period, generation of noise, construction expense, a large amount of scrap materials and their great processing expense, and a large amount of materials (expense) used for replacing (for example, asphalt mixture) etc.

And, also when a cutting overlay method is adopted, there occur problems such as, long construction period, construction expense, a large amount of scrap materials (cut materials) and necessity for great amount of their processing expense, and amount (expense) of asphalt mixture for overlaying.

When these problems are taken into consideration, it will become effective solution for construction period, construction expense, etc. to form an asphalt reinforced paved road using a road reinforcement sheet of the present invention. That is, the following advantages are mentioned when forming an asphalt reinforced paved road using a road reinforcement sheet of the present invention.

A road reinforcement sheet of the present invention is firmly bonded with an asphalt paving mixture used for an asphalt paving road and a concrete floor slab, etc. and thereby it becomes possible to give mechanical performance of the reinforcement sheet (1) to asphalt structure to improve strength of the asphalt paving, and while crack formed on the asphalt paving is reduced, rutting by flow of asphalt paving mixture is inhibited. Therefore, it becomes possible to reduce an amount and a thickness of asphalt paved on the road reinforcement sheet of the present invention. Accordingly, a thickness in cutting damaged asphalt paving front face may be mitigated only into a surface course part of the damage part, and this will lead to reduction of amount of scrap materials (cut materials), to reduction of expense, and to shortening of construction period.

A road reinforcement sheet of the present invention, and a structure of an asphalt reinforced paved road using the road reinforcement sheet concerned has outstanding performance that shows a durability in rutting and crack of asphalt paving formed on a road front face of not less than three times and not less than 1.5 times respectively compared with usual road, and therefore they are a road reinforcement sheet and a structure of asphalt reinforced paved road useful in economical efficiency, environment property, etc. in case of maintenance repair work of asphalt paving.

Although the present invention is hereinafter described still in detail by drawings and Examples, the present invention is not limited to the following Examples.

Various kinds of test methods used in the specification are conducted according to "Pavement Examination Method Manual" (the 14th issue of "Japanese Road Association" Nov. 16, 1998 first edition). Main examination methods are shown below.

Bending Test

Figure 15:
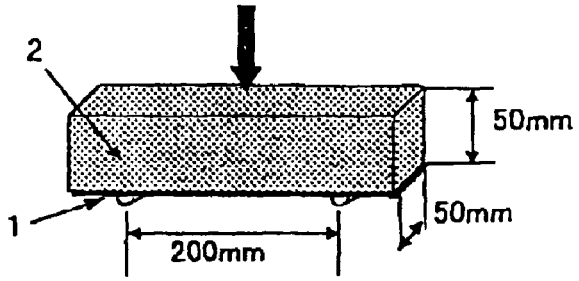
FIG. 15 is a conceptual view of a bending test measuring method.

In bending test, measurement was conducted under conditions of −10° C. and loading rate 50 mm/min as shown in FIG. 15, using a 50 mm×50 mm×300 mm piece of a sample comprising a reinforcement sheet layer and an asphalt layer (dense-graded 13 mm-straight asphalt: 60/80 parts). Arrow shows a load.

Fracture Energy of Bending Test

Area under a curve to a peak load in load-deformation curve in the above described bending test was defined as a fracture energy.

In obtaining a peak load, "Bending destruction quality and tensile softening curve of steel fiber reinforcement concrete" ("Japan Society of Civil Engineers memoir: 1993 No. 2, 460V-18, page 57") was used as a reference. Measurement of an area under a curve to peak load in a load-deformation curve was based on references below.

(1) "Characteristics of Glass Fiber Reinforcement cement": Composite material technical collection II-6-6, glass fiber reinforcement cement (GRC), (2) "Characteristics of glass fiber reinforced concretes (GRC)": Japan Society for Composite Materials magazine volume 13, No. 2 (1987) page 58.

Wheel Tracking Examination (Dynamic Stability)

Figure 16:
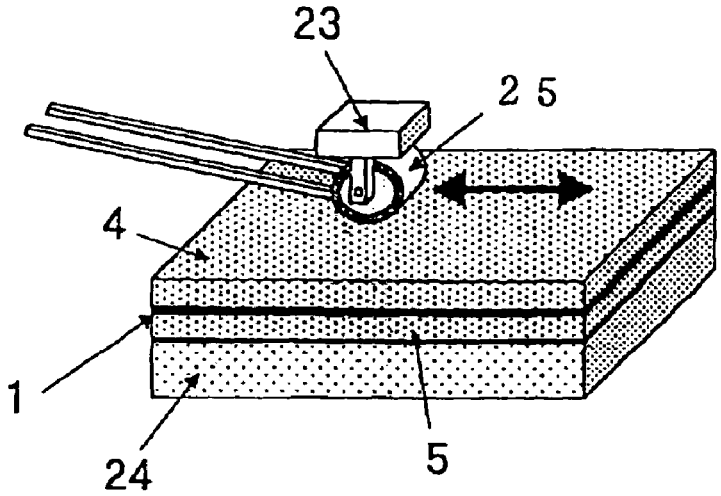
FIG. 16 is a conceptual view of a wheel tracking test measuring method.

Measurement was conducted as shown in FIG. 16, using a 300 mm×300 mm×50 mm piece of a sample comprising a reinforcement sheet layer-a binder course (dense-graded 13 mm-straight asphalt: 60/80 parts)-an asphalt mixture (straight asphalt, improved asphalt, drainage property asphalt, etc.) under conditions of 60° C., load 70 kgf, and load velocity 42 pass/min. Measurement was carried out at 50 mm from surface course or 30 mm from surface course (binder course 20 mm). Arrow shows a movement direction of a load.

EXAMPLE

Experiment 1 manufacture of a road reinforcement sheet

[Manufacture of a road reinforcement sheet]

Figure 5:
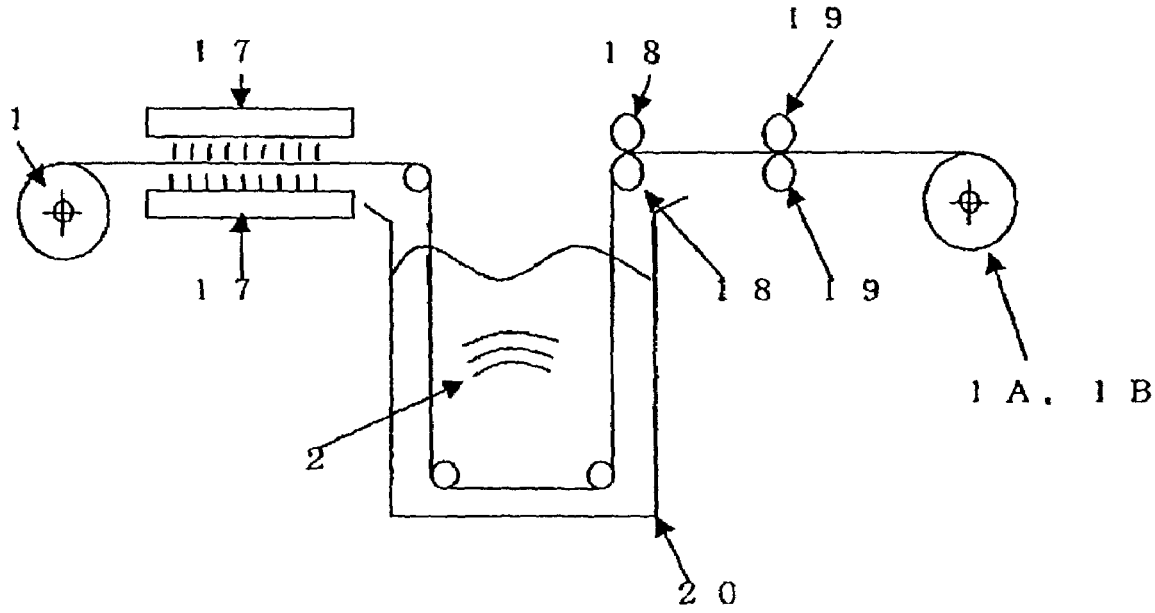
FIG. 5 is a figure showing an outline of one embodiment of equipment manufacturing a road reinforcement sheet of the present invention.
Figure 6:
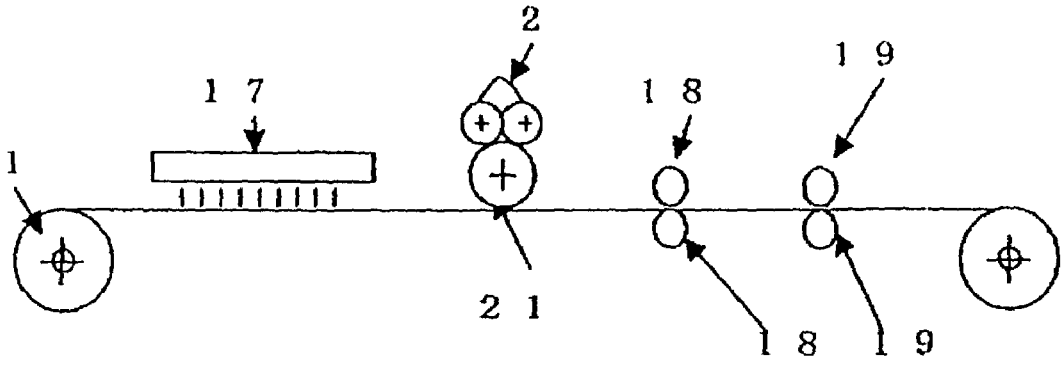
FIG. 6 is a figure showing an outline of other embodiment of an equipment manufacturing a road reinforcement sheet of the present invention.
Figure 7:
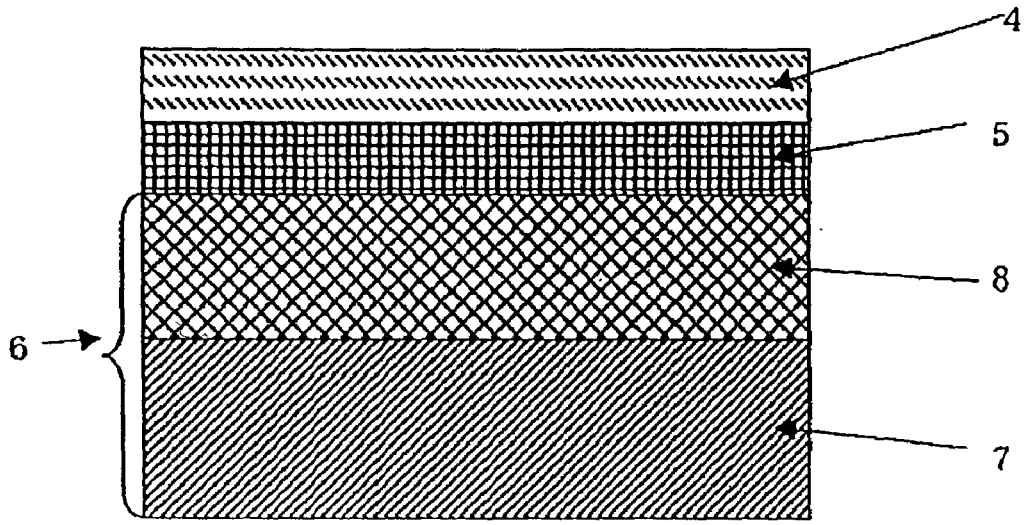
FIG. 7 is a sectional view of a general pavement constitution according to the present invention.
Figure 8:
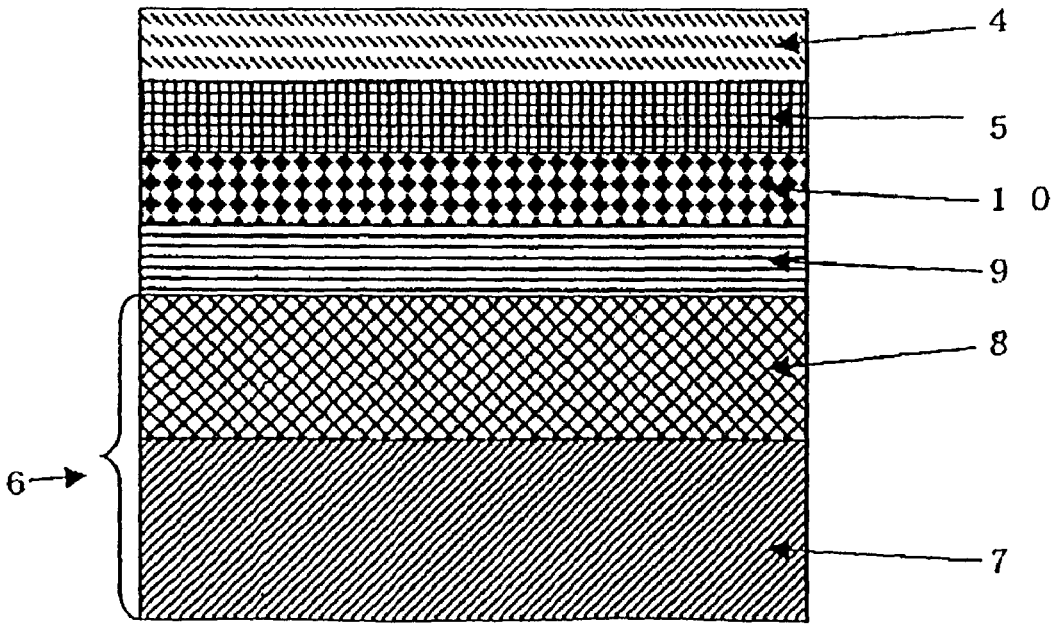
FIG. 8 is a sectional view of a general pavement constitution used for an application examination of a road reinforcement sheet of the present invention.
Figure 9:
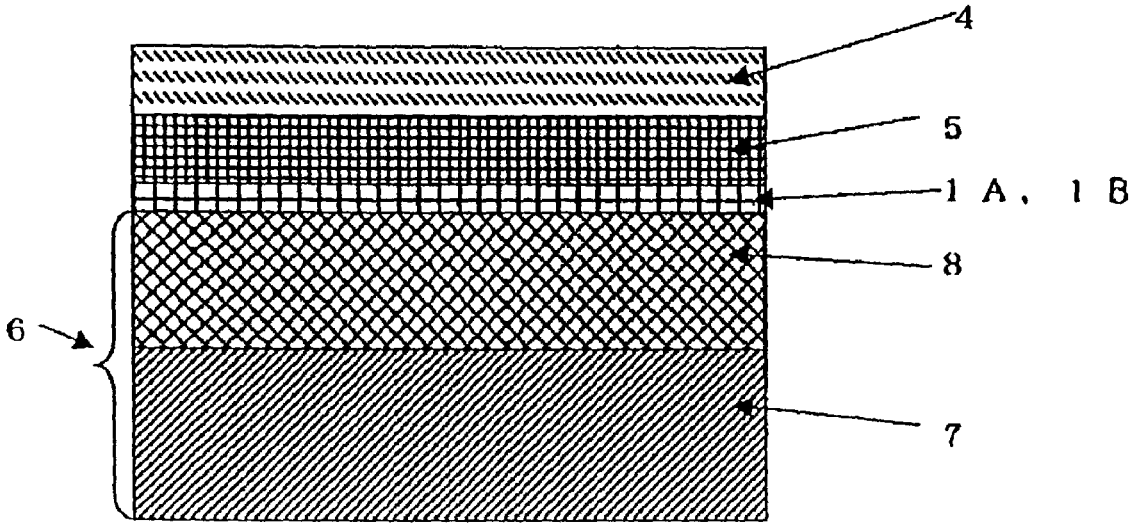
FIG. 9 is a pavement constitution sectional view of an application examination in which a road reinforcement sheet of the present invention is paved on a subbase course and subsequently a binder course and a surface course are paved.
Figure 10:
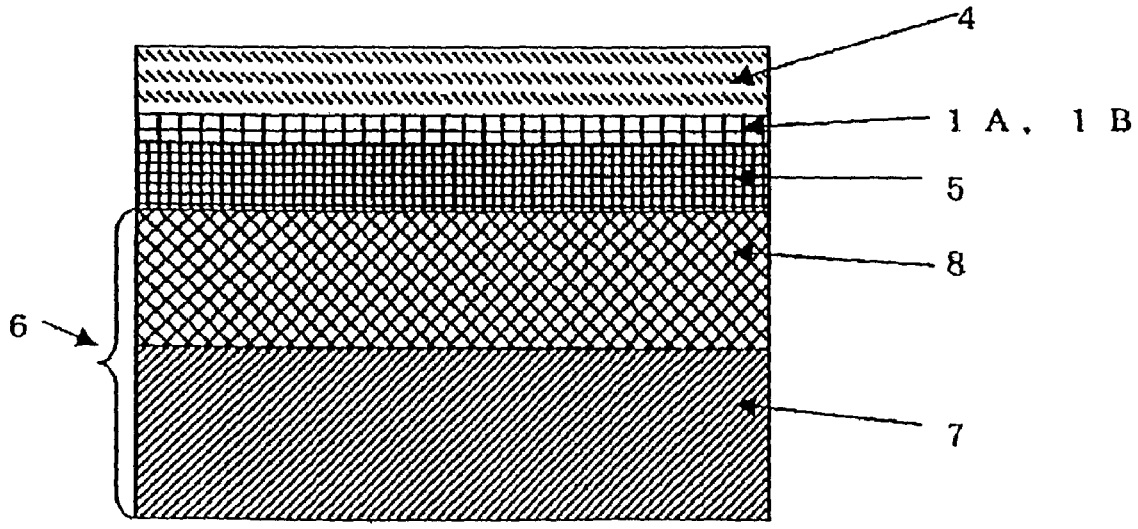
FIG. 10 is a pavement constitution sectional view of an application examination in which a binder course is paved on a subbase course, a road reinforcement sheet of the present invention is paved, and subsequently a surface course is paved.
Figure 11:
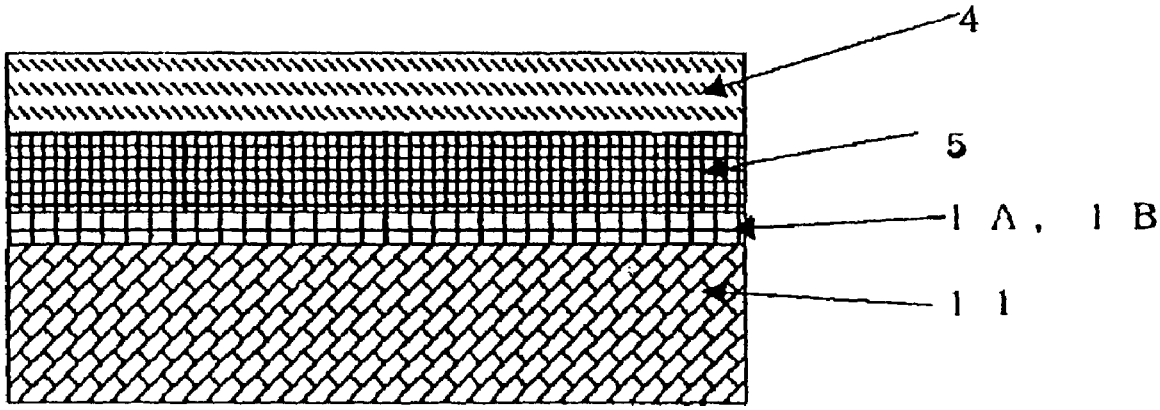
FIG. 11 is a pavement constitution sectional view of an application examination in which a road reinforcement sheet of the present invention is paved on an existing RC floor slab after cutting of existing road surface, and subsequently a binder course and a surface course are paved.
Figure 12:
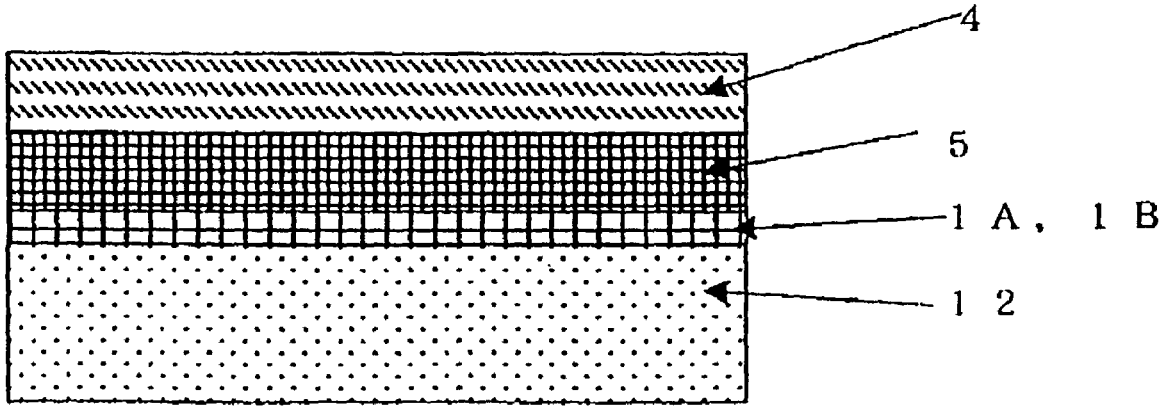
FIG. 12 is a pavement constitution sectional view of an application examination in which a road reinforcement sheet of the present invention is paved on an existing lower layer mastic asphalt layer after cutting of existing road surface, and subsequently a binder course and a surface course are paved.
Figure 13:
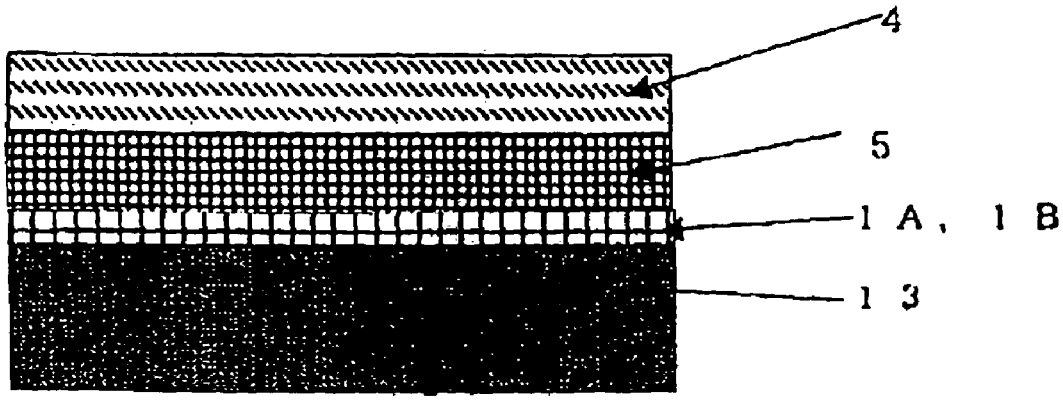
FIG. 13 is a pavement constitution sectional view of an application examination in which a road reinforcement sheet of the present invention is paved on a cut road surface after cutting of existing road surface, and subsequently a binder course and a surface course are paved.
Figure 14:
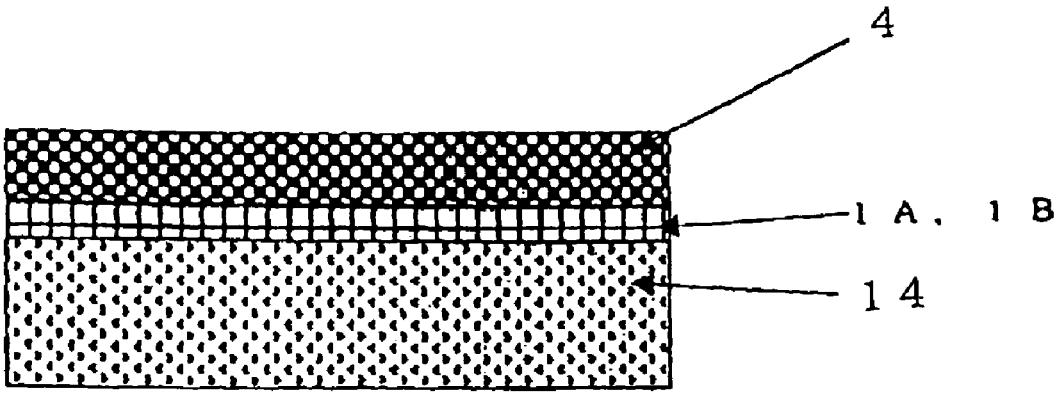
FIG. 14 is a pavement constitution sectional view of an application examination in which a road reinforcement sheet of the present invention is paved by floor slab thickening method on a road surface after jet cement application, and subsequently a surface course is paved.

A road reinforcement sheet in which asphalt layers (2) were laminated on both sides of a reinforcement sheet (1) was manufactured with equipment shown in FIG. 5. The reinforcement sheet (1), while being heated at not less than 180° C. with infrared heater from both sides, was passed through a container filled with asphalt heated at 200° C. at a rate of 5 m/min, thus asphalt was applied, passed between heating rolls heated at 180° C., subsequently passed between cooling rolls heated at 60° C. for cooling while thickness was adjusted. Thus, a road reinforcement sheet was obtained. As a reinforcement sheet (1), "Preglon" manufactured by Mitsui Chemicals, Inc. was used.

In this sheet, polyester nonwoven fabric with 15 g/cm$^2$ was arranged on both sides using a method of Example 1 of Japanese Patent Laid-Open No. 9-177014 using a sheet comprising glass fiber and polypropylene. A sheet was used that was additionally squeezed through with rolls within a container filled with asphalt in order to have it further mixed in an interface of the reinforcement sheet (1) and an improved asphalt layer (2), and in order to improve asphalt impregnation into nonwoven fabric.

(Improved asphalt used in this Example has properties of softening point of 110° C., penetration 20 to 30, viscosity (180° C.) of 6 Pa·s, and specific gravity of 1.02.)

"Preglon" which content of glass fiber is 50 wt. %, having a thickness of 270 micrometers, has physical properties of a tensile strength of 395 MPa, a tensile elongation of 2.2%, and a coefficient of thermal expansion of $5\times10^{-6}$/°C.

Experiment 2 basic physical properties of a road reinforcement sheet

Basic physical properties of the road reinforcement sheet obtained by the above described experiment are shown below (Table 1), and they were compared with similar sheets for the tensile strength (Table 2). As similar sheets, sheets of 2 mm thickness and 3 mm thickness were used in which nonwoven fabric was used for core material, and asphalt was impregnated. Tensile test was conducted according to JIS K7113 "Tensile test method of plastic." As for shearing adhesive strength and perpendicular adhesive strength, measurement was carried out according to "Floor slab waterproofing quality standard test method" by Japan Highway Public Corporation.

A tensile strength of the road reinforcement sheet showed a strength of not less than five times as high as conventional sheet materials.

TABLE 1

Basic physical properties of the road reinforcement sheet

| Items | Measured value |
|---|---|
| Tensile strength (length/width) | 68.6 kN/m |
| Shearing adhesive strength | 328 N/cm |
| Perpendicular adhesive strength | 66.6 N/cm$^2$ |

TABLE 2

Tensile strength comparison of the road reinforcement sheet and similar sheets

| Test piece | Tensile strength (kN/m) |
|---|---|
| Road reinforcement sheet | 68.6 |
| Similar sheet 1 for comparison (2 mm thickness) | 12 |
| Similar sheet 2 for comparison (3 mm thickness) | 8 |

Experiment 3 performance comparison for crack suppression effectiveness

In a case where a road reinforcement sheet obtained in experiment 1 was used, where a sheet was not used, and where a similar sheet was used, "bending test" and "repeated bending fatigue test" of the Pavement Examination Method Manual were performed, and comparison of crack suppression effectiveness was carried out. Test piece for bending test was prepared according to "bending test" of Pavement Examination Method Manual, and attachment of the road reinforcement sheet and similar sheet was carried out by lamination to a lower side of the asphalt mixture of test object by heat of asphalt mixture to be united. Test was carried out according to Pavement Examination Method Manual, and bending strength, strain at fracture, displacement to fracture, and fracture energy were measured.

A test piece of repeated bending fatigue test was prepared according to "bending test" of Pavement Examination Method Manual. Size of the test piece was 50 mm×50 mm×400 mm. In the test method, a constant temperature bath of a testing machine was maintained at 5° C. and 20° C., and load control was given in trisection loading at 5 Hz of loading rate, and a number of times of loading until a predetermined deformation (2 mm, 3 mm, 5 mm) was shown was investigated. Load given was set to 50% and 75% of a bending breaking strength of asphalt paving mixture at 20° C.

According to test results of the bending test, a fracture energy when using a road reinforcement sheet showed a value of not less than 15 times as high as a case where the sheet was not used, and a value of not less than 11 times as high as a case where a conventional sheet material was used. (Table 3)

According to results of this repeated bending fatigue test, a number of times of a load to a predetermined deformation when a road reinforcement sheet was used showed a value of not less than 5.5 times as high as a case where sheet was not used, and a value of not less than 7.5 times as high as a case where a conventional sheet material was used. (Table 4)

TABLE 3

Performance comparison for crack suppression effectiveness of a road reinforcement sheet by bending test

| Test object | Bending strength N/cm$^2$ | Strain at fracture | Displacement to fracture mm | Fracture energy kN-mm |
|---|---|---|---|---|
| Road reinforcement sheet | 912.4 | $5.6\times10^{-3}$ | 3.9 | 13.6 |
| With no sheet | 869.3 | $4.0\times10^{-3}$ | 1.2 | 0.9 |
| Similar sheet 1 for comparison (thickness 2 mm) | 903.6 | $5.2\times10^{-3}$ | 1.4 | 1.2 |
| Similar sheet 2 for comparison (thickness 3 mm) | 758.5 | $5.2\times10^{-3}$ | 1.2 | 0.8 |

TABLE 4

Performance comparison for crack suppression effectiveness of a road reinforcement sheet by repeated bending fatigue test

| Test object | Test temperature 5° C. Load 705.6N Displacement 2 mm Number of times of loading | Test temperature 5° C. Load 1048.6N Displacement 3 mm Number of times of loading | Test temperature 20° C. Load 705.6N Displacement 5 mm Number of times of loading | Test temperature 20° C. Load 1048.6N Displacement 5 mm Number of times of loading |
|---|---|---|---|---|
| Road reinforcement sheet | 31,667 | 25,000 | 7,333 | 700 |
| With no sheet | 5,667 | 4,667 | 833 | 300 |
| Similar sheet 1 for comparison (thickness 2 mm) | 2,333 | 2,333 | 567 | 300 |
| Similar sheet 2 for comparison (thickness 3 mm) | 4,000 | 3,000 | 633 | 300 |

Experiment 4 execution test for crack suppression effectiveness, and crack suppression effectiveness evaluation

[Execution Test]

Pavement test was carried out using a road reinforcement sheet manufactured in experiment 1.

Three sections (width of 4 m×length of 10 m) were dug down about 80 cm, and 40 cm lower layer subbase course (7) was prepared by crusher in the subgrade. Furthermore, an upper subbase course (8) with 25 cm was prepared with mechanically stabilized crushed stone on it.

A styrene foam plate (9) with a thickness of 5 cm was laid in order to form an condition where a subbase course (6) was softened on the upper subbase course (8). Furthermore, 8 cm of a layer of asphalt stabilization (10) was paved to prepare a test section.

Each of this test section was classified into a first section in which a road reinforcement sheet was not paved and a binder course (5) and a surface course (4) were paved, a second section in which a road reinforcement sheet was paved under the binder course (5), and a third section in which a road reinforcement sheet was paved under the surface course (4), and pavement test was carried out.

In the first section, on a layer of asphalt stabilization (10) 5 cm of binder course (5) and 5 cm of surface course (4) were paved without a road reinforcement sheet to prepare a paved road. In the second section, a road reinforcement sheet was paved on a layer of asphalt stabilization (10), subsequently 5 cm of binder course (5) and 5 cm of surface course (4) were paved to prepare a paved road. In the third section, 5 cm of a binder course (5) was paved on a layer of asphalt stabilization (10), subsequently on it a road reinforcement sheet was paved, and 5 cm of a surface course (4) was paved to prepare a paved road.

In all of the above described asphalt pavings, manufacturing delivering was carried out at 140° C., and the delivered material was used. Placing and spreading by usual asphalt finisher having a single tamper and a vibration screen were carried out. Rolling compaction was carried out by a large-sized vibration roller and a pneumatic tire roller at rolling temperature of 110° C. In the test, at 12 hours after the finalization of pavement, road was opened and observation of pavement face was carried out.

After the road was opened, there was a vehicular traffic of an average of 6000 per day.

Surface course crack forming period of the pavement face showed 1.6th year for the first section, 2.9th year for the second section, and 3.6th year for the third section respectively.

Next, a thickness of a surface course asphalt of the second section and the third section were set to 4 cm to carry out a test, and a markedly more excellent result than in the first section as in the case of 5 cm was obtained.

Experiment 5 execution test for crack suppression effectiveness, and crack suppression effectiveness evaluation

[Execution Test]

Pavement test was carried out using a road reinforcement sheet manufactured in experiment 1.

In a road whose traffic volume is D-case, after established road surface was cut by 10 cm, a road reinforcement sheet was paved on an existing RC floor slab (11) joint, and subsequently two-layer overlay by a 4 cm of binder course (5) (improved type II dense-graded asphalt mixture) and by a 4 cm of surface course (4) (asphalt mixture for drainage pavement) was carried out.

Pavement method of construction was according to asphalt paving requirements, and was the same as conventional paving method. In paving of a road reinforcement sheet, the road reinforcement sheet concerned was paved while pouring heated and molten asphalt. Road surface situation at one year and a half after execution was observed. Then, it was confirmed that crack was not contained after one year and a half in the surface course asphalt.

Experiment 6 execution test for crack suppression effectiveness, and crack suppression effectiveness evaluation

[Execution Test]

Pavement test was carried out using a road reinforcement sheet manufactured in experiment 1.

In a road whose traffic volume is D case, after established road surface was cut by 4 cm, a road reinforcement sheet was paved in a part of crack through surface course to lower layer mastic asphalt layer (12), and 4 cm of one-layer overlay by a surface course (4) (dense-graded asphalt mixture) was carried out.

Pavement method of construction was according to asphalt paving requirements, and was the same as conventional paving method. In paving of a road reinforcement sheet, the road reinforcement sheet concerned was paved while pouring heated and molten asphalt. Road surface situation at one year and a half after execution was observed. Then, it was confirmed that crack was not contained after one year and a half in the surface course asphalt.

Experiment 7 performance comparison for rutting suppression effectiveness

In a case where a road reinforcement sheet obtained in experiment 1 was used, where a sheet was not used, and where a similar sheet was used, "wheel tracking test" of Pavement Examination Method Manual was carried out, and a comparison of rutting suppression effectiveness was carried out.

Test piece was prepared according to 3-3-7 "wheel tracking test" of Pavement Examination Method Manual, and attachment of a road reinforcement sheet and a similar sheet was carried out according to each sheet execution manual. In test method, dynamic stability was measured according to Pavement Examination Method Manual. According to this wheel tracking test results, a dynamic stability when using a road reinforcement sheet showed a value of not less than 1.5 times as high as in a case where a sheet was not used, and of not less than 2.5 times as high as in a case where a conventional sheet material was used. (Table 5) Moreover, it was confirmed that it had a sufficient strength when a surface course was 3 cm, and that a thin surfacing might be possible.

TABLE 5

Performance comparison for rutting suppression effectiveness of a road reinforcement sheet

| Cross section of test object constitution | | Sheet | Dynamic stability (turn/mm) |
|---|---|---|---|
| 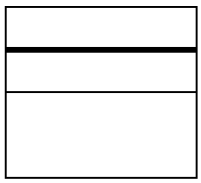 | Surface course (4) 30 mm | Road reinforcement sheet | 1,004 |
| | | With no sheet | 666 |
| | | Similar sheet 1 for comparison (2 mm thickness) | 395 |
| | Sheet | Similar sheet 2 for comparison (3 mm thickness) | 245 |
| | Binder course (5) 20 mm | | |
| | Simulation subbase course (RC) | | |
| 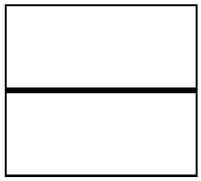 | Surface course (4) 50 mm | Road reinforcement sheet | 658 |
| | | With no sheet | 666 |
| | | Similar sheet 1 for comparison (2 mm thickness) | 345 |
| | | Similar sheet 2 for comparison (3 mm thickness) | 209 |
| | Sheet | | |
| | Simulation subbase course (RC) | | |

Experiment 8 execution test for rutting suppression effectiveness, and rutting suppression effectiveness evaluation

[Execution Test]

Pavement test was carried out using a road reinforcement sheet manufactured in experiment 1.

In a road whose traffic volume is C-case, on a surface where 5 cm cut was given (13), two portions were prepared where a road reinforcement sheet was paved and where not paved, and subsequently, one-layer overlay (5 cm) was carried out by surface course (4) (improved II type dense-graded asphalt mixture).

Road surface situation at one year after execution was measured with crossing profiling meter. Pavement method of construction was according to asphalt paving requirements, and was the same as conventional paving method. In paving of a road reinforcement sheet, the road reinforcement sheet concerned was paved while pouring heated and molten asphalt.

(Table 6)

Next, a test was carried out by setting a thickness of a cut face (13) to 4 cm, and a markedly excellent result as in a case by 5 cm was obtained.

TABLE 6

| Measured part | Amount of rut 1 | Amount of rut 2 |
|---|---|---|
| With reinforcement sheet | 2.88 mm | 1.55 mm |
| Without reinforcement sheet | 3.41 mm | 3.25 mm |

In Table 6, amount of rut 1 and 2 shows data in different places on a road.

Experiment 9 execution test for rutting suppression effectiveness, and rutting suppression effectiveness evaluation

[Execution Test]

Pavement test was carried out using a road reinforcement sheet manufactured in experiment 1.

In a road whose traffic volume is D case, two portions were prepared where a road reinforcement sheet was paved and where not paved, after jet cement (14) was applied by a floor slab top face thickening method, and subsequently, one-layer overlay (5 cm) was carried out by a drainage pavement (15).

Road surface situation after execution and after one year was measured with a crossing profiling meter. Pavement method of construction was according to asphalt paving requirements, and was the same as conventional paving method. In paving of a road reinforcement sheet, the road reinforcement sheet concerned was paved while pouring heated and molten asphalt.

(Table 7)

Next a test was carried out by setting one-layer overlay to 4 cm, a markedly excellent result as in a case by 5 cm was obtained.

TABLE 7

| Measured part | Amount of rut |
|---|---|
| With reinforcement sheet | 3.68 mm |
| Without reinforcement sheet | 4.81 mm |

Experiment 10 execution test for crack suppression effectiveness, and crack suppression effectiveness evaluation

[Execution Test]

Pavement test was carried out using a road reinforcement sheet manufactured in experiment 1.

After 3 cm of established road surface was cut, a road reinforcement sheet was paved on a part where a crack was formed in the cut road surface (13), and subsequently one-layer overlay of 3 cm in surface course (5) (improved II type dense-graded asphalt mixture) (as the improved II type asphalt, Senafurto, trade name: product manufactured by BRIDGESTONE CORPORATION, was used) was carried out. Pavement method of construction was according to asphalt paving requirements, and was the same as conventional paving method. In paving of a road reinforcement sheet, the road reinforcement sheet concerned was paved while pouring heated and molten asphalt. Road surface situation at one year after execution were observed. Then, it was confirmed that crack was not contained after one year and a half in the surface course asphalt.

Experiment 11 execution test for crack suppression effectiveness, and the crack suppression effectiveness evaluation

[Execution Test]

Pavement test was carried out using a road reinforcement sheet manufactured in experiment 1.

After 3 cm of established road surface was cut, a road reinforcement sheet was paved on a part where a crack was formed in the cut road surface (13), and subsequently one-layer overlay of a drainage pavement road surface (15) 3cm was carried out. Pavement method of construction was according to asphalt paving requirements, and was the same as conventional paving method. In paving of a road reinforcement sheet, the road reinforcement sheet concerned was paved while pouring heated and molten asphalt. Road surface situation at one year after execution were observed. Then, it was confirmed that crack was not contained after one year and a half in the surface course asphalt.

Experiment 12 execution test for rutting suppression effectiveness, and rutting suppression effectiveness evaluation Pavement test was carried out using a road reinforcement sheet manufactured in experiment 1.

A binder course (coarse-graded asphalt mixture) was paved 4 cm on a road surface (13) that was cut by 8 cm, two portions were prepared where a road reinforcement sheet was paved and where not paved, and subsequently, a surface course (improved II type dense-graded asphalt mixture) was paved by 4 cm. Pavement method of construction was according to asphalt paving requirements, and was the same as conventional paving method. In paving of a road reinforcement sheet, the road reinforcement sheet concerned was paved while pouring heated and molten asphalt. Road surface situation at one year after execution was measured with a crossing profiling meter. Measurement results are shown in Table 8.

TABLE 8

| Measured part | Amount of rut 1 | Amount of rut 2 |
|---|---|---|
| With reinforcement sheet | 2.55 mm | 1.25 mm |
| Without reinforcement sheet | 3.51 mm | 3.35 mm |

Experiment 13 performance comparison of crack suppression effectiveness in drainage property road "Bending test" was carried out to compare crack suppression effectiveness, in a case where a road reinforcement sheet obtained by experiment 1 was used, and where a reinforcement sheet was not used.

Test piece of the bending test had a size of 50 mm×50 mm×300 mm, and measurement was performed using asphalt mixture for drainage pavement. Attachment of the road reinforcement sheet was carried out by lamination to a lower side of the asphalt mixture of test object by heat of asphalt mixture to be united. Bending strength, displacement to fracture (amount of deflection), and fracture energy were measured. Results are shown in Table 9.

From results of Table 9, a fracture energy when reinforcement sheet was used showed about 14 times as large as in a case where the sheet was not used.

TABLE 9

Performance comparison in crack suppression effectiveness of road reinforcement sheet

| | Bending strength (MPa) | Amount of deflection (mm) | Fracture energy (J) |
|---|---|---|---|
| With Road reinforcement sheet used | 8.90 | 2.5 | 7.32 |
| Without sheet | 4.56 | 0.5 | 0.51 |

Experiment 14 performance comparison for rutting suppression effectiveness in drainage property road In two cases where a road reinforcement sheet obtained by experiment 1 was used, and where a reinforcement sheet was not used, "wheel tracking test" was carried out to compare dynamic stability.

A asphalt mixture for drainage pavement as in experiment 13 was used, laminated and measured. Results are shown in Table 10.

TABLE 10

Performance comparison for rutting suppression effectiveness in drainage property road

| Cross section of test object constitution | Type of surface course asphalt | With or without reinforcement sheet | Dynamic stability (turn/mm) |
|---|---|---|---|
| 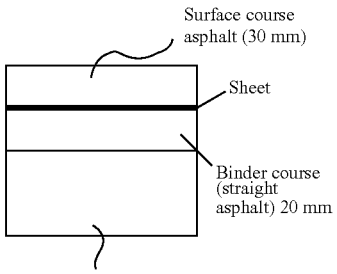  | Drainage property asphalt | With<br>Without | 6,443<br>3,529 |

According to results of Table 10, dynamic stability in a case where a reinforcement sheet was used showed approximately twice as high as the one in a case where the sheet was not used.

In addition, a test was carried out for a sheet used in this Example according to shearing adhesive strength test of Japan Highway Public Corporation Research Institute data No. 124, exfoliation between reinforcement sheet/asphalt layer was not observed.

Example 14 and Comparative Example

Using various reinforcements, various reinforcement sheets were arranged on top of binder course asphalt with a thickness of 20 mm, then test pieces of surface course asphalt with a thickness of 40 mm were prepared thereon, and bending test was carried out. Results are shown in Table 11. In addition, improved asphalt II type of 13 mm dense-graded was used as asphalt.

TABLE 11

| | Strength of initial crack formation (KN) | Amount of deflections to fracture (mm) | Energy to fracture (J) |
|---|---|---|---|
| Without reinforcement sheet | 7.4 | 1.23 | 2.80 |
| Preglon | 8.1 | 1.83 | 7.69 |
| GF reinforced type A | 6.6 | 1.14 | 3.09 |
| GF reinforced type B | 6.6 | 1.04 | 2.12 |
| GF reinforced type C | 6.5 | 1.10 | 3.03 |
| Synthetic fiber reinforced type | 7.2 | 1.09 | 2.24 |

INDUSTRIAL APPLICABILITY

A road reinforcement sheet, and a structure of asphalt reinforced paved road of the present invention show a remarkably excellent durability to rutting and crack of asphalt paving that are generated by increase in traffic, and increase in traffic load which are becoming social problems in recent years.

With the above described performance, especially a thin surfacing (thin layer pavement) paving with thickness of asphalt made thinner becomes possible, and, as a result, following effectiveness may be acquired;

1. Cost cut and shortening of time required for completion are attained by reduction of amount of asphalt used;
2. Since in a case of road repairing with a thin surface course, the amount of wastes is reduced, cutting time is shortened, traffic interrupting time of a road is shortened, and environmental problems, such as noise, are mitigated;
3. Since traffic of car is enabled on the reinforcement sheet itself of the present invention, passing of car is enabled even during the construction, and thus time necessary for completion is greatly shortened.

The invention claimed is:

1. A paved road including a reinforcement sheet layer (1A) and a pavement layer (22), wherein said reinforcement sheet layer (1A) includes an asphalt layer (2) laminated to at least one side of a reinforcement sheet (1) including a composite material that is impregnated with a thermoplastic resin so that a volume content of a continuous glass fiber is not less than 30% and not more than 85% using the continuous glass fiber as reinforcement fiber, and a thickness of the pavement layer (22) is 40 to 15 mm, wherein the paved road resists rutting and cracking under heavy automobile traffic conditions.

2. The paved road according to claim 1, wherein the reinforcement sheet layer (1A) is further a reinforcement sheet layer (1B) having a woven fabric layer or a nonwoven fabric layer (3) containing natural fiber or synthetic fiber on at least a part of face between the reinforcement sheet (1) and the asphalt layer (2).

3. The paved road according to claim 1, including a reinforcement sheet layer (1A) and a pavement layer (22), wherein said reinforcement sheet layer (1A) includes an asphalt layer (2) laminated to both sides of a reinforcement sheet (1) including a composite material that is impregnated with a thermoplastic resin so that a volume content of a continuous glass fiber concerned is not less than 30% and not more than 85% using the continuous glass fiber as reinforcement fiber.

4. The paved road according to claim 1, wherein the reinforcement sheet (1) has a tensile strength of not less than 290 MPas, a tensile elongation of not more than 10%, a coefficient of thermal expansion of $2\times10^{-6}$ to $8\times10^{-6}$/° C., and a thickness of 100 micrometers to 600 micrometers.

5. The paved road according to any of claims 1 to 3, wherein the asphalt layer (2) has a thickness of not less than 400 micrometers and not more than 2000 micrometers.

6. The paved road according to claim 1, wherein, when shearing peel strength being performed for the reinforcement sheet (1) and the asphalt layer (2), the layers are bonded mutually with a strength of not less than a force of coagulation of asphalt layer (2).

7. The paved road according to claim 1 wherein the pavement layer has a fracture energy by a bending test of not less than 4 kN-mm.

8. The paved road according to claim 1 wherein the pavement layer has a dynamic stability by a wheel tracking test of not less than 600 turn/mm.

9. The paved road according to any of claims 1 to 3, wherein the pavement layer (22) provides drainage, and the reinforcement sheet layer (1A or 1B) provides seepage control, the paved road draining rainwater in a direction of a road shoulder along an upper surface of the reinforcement sheet layer (1A or 1B) without permeating rainwater penetrated via the pavement layer (22) into a subbase course.

10. A structure of a road comprising the paved road according to claim 1.

11. A structure of a temporary road used during road repairing comprising the paved road according to claim 1.

12. A repairing method of a paved road comprising, after formation of a crack, rut, or loss portion on a pavement surface on the paved road with asphalt or concrete, after at least a part of a surface of the paved road is cut, and after the crack or the loss portion is optionally partially repaired, preparing the paved road according to any of claims 1 to 3.

13. A repairing method of a paved road comprising, after a surface is cut and a crack or loss portion is partially repaired on the paved road with asphalt or concrete, preparing the paved road according to claim 9 having a function of draining rainwater in a direction of a road shoulder.

* * * * *